US010775040B2

(12) United States Patent
Austin

(10) Patent No.: US 10,775,040 B2
(45) Date of Patent: Sep. 15, 2020

(54) ANNULAR SUPERHEATING ELEMENT FOR FIRETUBE BOILERS

(71) Applicant: James Matthew Austin, Kaneohe, HI (US)

(72) Inventor: James Matthew Austin, Kaneohe, HI (US)

( * ) Notice: Subject to any disclaimer, the term of this patent is extended or adjusted under 35 U.S.C. 154(b) by 216 days.

(21) Appl. No.: 15/381,682

(22) Filed: Dec. 16, 2016

(65) Prior Publication Data

US 2018/0172267 A1 Jun. 21, 2018

(51) Int. Cl.
*F22G 1/02* (2006.01)
*F22G 3/00* (2006.01)

(52) U.S. Cl.
CPC ..... *F22G 1/02* (2013.01); *F22G 3/006* (2013.01)

(58) Field of Classification Search
CPC ..... F22G 1/02; F22G 3/006
USPC ..... 122/463
See application file for complete search history.

(56) References Cited

U.S. PATENT DOCUMENTS

| | | | | |
|---|---|---|---|---|
| 774,335 | A | 11/1904 | Notkin | |
| 789,297 | A | 5/1905 | Schmidt | |
| 904,129 | A | 11/1908 | Horsey | |
| 1,070,115 | A | 8/1913 | Coates | |
| 1,227,435 | A | 5/1917 | Heenan | |
| 1,495,759 | A | 5/1924 | Milne | |
| 1,495,760 | A | 5/1924 | Milne | |
| 1,708,054 | A | 4/1929 | Cruse | |
| 1,725,485 | A | 8/1929 | Shupert | |
| 1,996,134 | A | 4/1935 | Williams | |
| 2,068,412 | A | 5/1935 | Hinsch | |
| 2,007,559 | A | 7/1935 | Berger | |
| 2,009,961 | A | 7/1935 | Krauss | |
| 2,072,674 | A | 3/1937 | Hard | |
| 2,148,025 | A | 2/1939 | Koehler | |
| 2,240,372 | A * | 4/1941 | Huet | F22G 7/065 122/462 |

(Continued)

FOREIGN PATENT DOCUMENTS

| | | | |
|---|---|---|---|
| GB | 191024407 | A | 6/1911 |
| GB | 191210007 | A | 5/1913 |

(Continued)

*Primary Examiner* — Steven B McAllister
*Assistant Examiner* — John E Bargero
(74) *Attorney, Agent, or Firm* — Watanabe Ing LLP; Seth M. Reiss

(57) ABSTRACT

An annular superheater element for superheating steam within firetubes of firetube boilers comprising concentric inner and outer tubes and a specially designed return end cap. Saturated steam introduced into the outer tube of said superheater element is superheated while traveling towards the burner end of the tube, is directed into the inner tube by means of the return end cap, and travels away from the burner side of the element where it is exhausted for use as superheated steam. While traversing the inner tube, the superheated steam gives off heat energy through the wall of the inner tube to the steam traveling in the outer tube towards the burner end of the tube, conserving energy. The improved superheater element produces superheated steam more efficiently, with less fuel, and steam capable of doing more work, than conventional superheater elements and can be used to retrofit existing firetube type boilers.

16 Claims, 7 Drawing Sheets

(56) References Cited

U.S. PATENT DOCUMENTS

| | | | | |
|---|---|---|---|---|
| 2,517,489 | A | 8/1950 | Huet | |
| 3,259,108 | A | 7/1966 | Craig et al. | |
| 4,023,508 | A | 5/1977 | Cantrell, Jr. et al. | |
| 4,538,551 | A | 9/1985 | Brady | |
| 4,541,845 | A * | 9/1985 | Michel-Kim ..... | B01D 45/16<br>210/243 |
| 5,056,209 | A | 10/1991 | Ohashi et al. | |
| 5,207,776 | A | 5/1993 | Pearce | |
| 2009/0266529 | A1 | 10/2009 | Jahier | |

FOREIGN PATENT DOCUMENTS

| | | | |
|---|---|---|---|
| GB | 191418144 | A | 1/1915 |
| GB | 184352 | A | 8/1922 |
| GB | 793073 | A | 4/1958 |

* cited by examiner

ANNULAR SUPERHEATING ELEMENT FOR FIRETUBE BOILERS

CROSS-REFERENCE TO RELATED APPLICATION

There are no related patent applications.

STATEMENT REGARDING FEDERALLY SPONSORED RESEARCH

The invention described herein was not made pursuant to a government agency grant or contract. No government funds were utilized in the described invention.

FIELD OF THE INVENTION

The present invention relates to superheaters for firetube-style steam boilers. More specifically, the subject invention describes an annular superheating element capable of producing superheated steam more efficiently than currently available superheating boilers.

BACKGROUND OF THE INVENTION

Firetubes are tubes used in some steam boilers to convey heated gases from one tube sheet to an opposite tube sheet of a boiler. Heated gases traverse the firetube, conducting heat through the firetube's wall and transferring heat energy to the water that surrounds the firetube. Gases exit the opposite tube sheet at a significantly lower temperature.

Steam boilers capable of producing superheated steam comprise superheater elements having steam flowing within the element tube, and with hot gases within firetubes flowing on the outside of the superheater elements.

A superheater element consists of a superheater tube that conducts the flow of steam into and out of a firetube in order to impart heat energy from the high temperature gases in the firetubes to the saturated steam inside the superheater elements, causing the steam to exit the superheater element with more useful energy per unit volume of steam than if the steam were not superheated.

Currently, most commercial steam boilers 55 are either of the scotch wet-back horizontal firetube type, illustrated by example in FIG. 1A, or the scotch dry-back horizontal firetube type, illustrated by example in FIG. 1B. In these steam boilers, a burner source 3 burns fuel in a relatively large furnace tube and heats the gas therein. The high temperature gases exit the furnace tube, execute a 180 degree turn, and flow through relatively small diameter firetubes stretched between two tube sheets. Tube sheets are plates that secure the pressure boundaries of the firetubes and hold the firetubes in place. The scotch wet-back horizontal firetube boiler illustrated in FIG. 1A has three tube sheets, whereas the scotch dry-back horizontal firetube boiler illustrated in FIG. 1B has two tube sheets.

The current boiler art uses one furnace tube of appropriate diameter to promote the most efficient combustion for the design steaming capacity and as many small diameter tubes as possible to create large surface area to accommodate efficient convective heat transfer rates across the tube walls from the heated furnace gases. In the case of horizontal firetube boilers, illustrated in FIGS. 1A and 1B, the furnace tube and the many small diameter gas firetubes are surrounded by water in a steel cylinder boiler designed to withhold the design boiler pressure. As the high temperature gases flow through the one large diameter furnace tube and multiple smaller diameter firetubes, the high temperature gases give up heat to boil water 11 inside the pressure boundaries of the boiler. The saturated steam of the boiling water 11 collects in the steam space at the top portion of the boiler and exits through a valve at the top wall of the boiler.

Some boilers are designed to circulate the heated furnace gases several times back and forth through different banks of tubes, called "passes," in order to extract as much heat as possible before exhausting the gases out the smokestack 50 to the atmosphere. Boilers of the locomotive type combust the fuel in a firebox and exhaust the gases after only one pass through the firetubes. The scotch wet-back horizontal firetube steam boiler shown in FIG. 1A has three passes and the scotch dry-back horizontal firetube steam boiler shown in FIG. 1B has two passes.

The steam generating capacity of a given boiler is dictated by the size of the space the boiler can occupy. The boilers are typically cylindrical, being the strongest practical shape to contain pressurized fluids. Greater steam generating capacity is achieved by making the boiler shells larger in diameter and increasing the distance between the tube sheets.

Efficiency of the boiler is increased by diverting the gases through several passes to increase the tube surface area the gases are exposed to before exhausting the heated gases through smokestack 50.

The laws of physics regarding heat transfer and gas flow dictate the cross-sectional area for a given firetube to achieve the most efficient combustion and heat transfer. Firetubes with smaller diameters have less volume for the high temperature gases to flow through but have greater surface area to volume ratios which means more surface area to absorb heat. Optimal firetube efficiency is achieved by balancing the amount of hot gases flowing in a given period of time verses the overall surface area for heat transfer.

Superheated steam at a given pressure has a higher temperature than the temperature at which water boils at that same pressure. For example, at 14.7 pounds per square inch (1 bar) (sea level), superheated steam would have a temperature higher than 212° F. (100° C.), which is the temperature of regular saturated steam from boiling water at that pressure; or at 150 pounds per square inch (10 bar), which is approximately ten times sea level atmospheric pressure, superheated steam will have a temperature higher than 366° F. (186° C.), which is the temperature of regular saturated steam from boiling water at that pressure. To superheat steam, it must be collected from the boiler and subjected to additional heat input from either an external heat source or the furnace gases.

The advantage of superheated steam is the ability to transfer more thermal energy from the boiler source to the destination at a given pressure with less boiled water. This allows more energy to be transmitted with the same amount of steam without increasing pressure or the infrastructure of the piping system.

Superheating steam in firetube boilers is well known in the art. Typical prior art embodiments comprise adding significantly larger firetubes in the boiler, with a small diameter superheater tube filled with steam passing down within a single firetube from one end and a small radius u-bend in the superheater tube to send the steam back out the same firetube in the opposite direction. The superheater tubes reverse direction inside the large diameter tubes at least once, and in some embodiments twice. FIG. 2A depicts an example of a one-directional flow firetube superheater with multiple u-turns or passes. A portion on the left of the one directional flow firetube superheater tube is cut out to illustrate the inside structure of one of the u-turn bends in the superheater tube.

Among the disadvantages of these prior art one-directional flow superheater tubes with one or more u-turn bends are:

They require large diameter firetubes, lowering the total number of firetubes that can be utilized in a given diameter boiler for a specific sized boiler shell. The total heating surface for water to cause steam generation is thereby reduced, reducing the boiler steam generating capacity.

As the steam flows through the superheater element making multiple passes through the firetube, with each pass being from the low temperature end to the high temperature end of the firetube and then back to the low temperature end, the temperature of the furnace gases drop exponentially. The steam in the outbound superheater tube, being heated to a high degree in the high temperature end of the firetube, has a higher temperature than the gases in the low temperature end of the firetube. At a certain point along the firetube, the steam in the outbound superheater tube will have a higher temperature than the continually cooling adjacent furnace gases. At this point, the superheating process becomes counterproductive as the superheater tube is now giving up heat to the furnace gases that are exiting the firetube, possibly to the exhaust of the boiler. This thermodynamic effect is illustrated in the prior art firetube boiler schematic of FIG. 2B, and explained in more detail in below.

An object of this subject invention is to provide a superheater element that overcomes the disadvantages of the currently available superheater elements.

A further object of the current invention is to superheat steam without requiring an additional external heat source to heat the saturated steam into superheated steam.

A further object of the current invention is to superheat steam using the furnace gases used to heat the boiler water into saturated steam.

A further object of the current invention is to provide a superheater element that produces superheated steam more efficiently than currently available superheater elements.

A further object of the subject invention is to provide a superheater element wherein the superheated steam circulating within the firetube does not lose any heat energy to the firetube gases.

A further object of the subject invention is to provide a superheater element that uses fuel more efficiently than currently available superheater boilers.

A further object of the subject invention is to provide a superheated boiler that can produce more superheated steam with less fuel, produce superheated steam at a higher temperature with the same amount of fuel, or produce superheated steam having the potential to do more work with the same amount of fuel.

A further object of the subject invention is to provide an improved superheater element that can be easily and inexpensively retrofitted into conventional firetube boilers.

SUMMARY OF THE INVENTION

These objects are accomplished in the present invention, an annular superheater element that re-circulates superheated steam in a manner to increase the efficiency of the heating provided by the boiler firetube. The present invention solves the problems identified in the prior art. The improved annular superheating element of the present invention produces temperatures of superheated steam having a materially higher temperature using the same energy input, superheated steam at the same temperature with considerably less energy input, and superheating steam capable of doing more work relative to currently available firetube boilers using the same amount of fuel. The annular superheater element of the subject invention conserves energy and the expense of fuel, producing superheated steam that can do more work with greater efficiency for a given amount of fuel.

The superheater element of the subject invention comprising two concentric tubes—an outer tube and an inner tube—and a return end cap. The return end cap causes the superheated steam flowing within the annular channel bounded by the outer and inner tube to be directed and returned through the inner tube.

The annular superheater element of the present invention is materially different from annular superheater elements described in the prior art in a number of important respects including, without limitation, the improved superheater element's ability to efficiently absorb thermal energy in the first steam pass between the inner and outer tubes, and a specially designed return end cap that efficiently and reliably redirects the superheated steam from the first pass channel into the inner tube. As used herein, first pass channel means the annular steam path bounded by the outer tube and the inner tube, which resides concentrically about a secondary inner tube (defining the second pass channel) of smaller diameter.

The superheater element of the subject invention can be inserted in a firetube of a conventional firetube-style boiler. The saturated steam within the element is conducted through the first pass channel to the return end cap which redirects the flow through the second pass channel.

The annular configuration of the superheater element functions such that the external temperature of the superheater element, the firetube, and the saturated steam, are all at the same temperature at the tube sheet end where the furnace gases exit. As such, steam in the superheater element does not lose any heat to the surrounding furnace gases.

The steam temperature within the superheater element first pass channel increases as the steam flows toward the high temperature (furnace gas entrance) end of the firetube. The highest steam temperature is achieved at the end of the superheater element where the return end cap reverses the steam flow to cause the steam to flow into the inner tube. As the steam is diverted and flows through the second pass channel, the higher temperature steam imparts heat to the lower temperature incoming steam traveling in the opposite direction in the first pass channel. The incoming saturated steam traveling within the first pass channel is heated both by the heat of the furnace gases being absorbed through the outside wall of the outer tube and the heat of the higher temperature superheated steam in the second pass channel that is being absorbed through the wall of the inner tube. This configuration, where the highest difference in temperatures exists across the heating surfaces, is the most efficient configuration possible for heat transfer.

The final superheat, that is, the temperature of the superheated steam exiting the superheater element, will be determined by the steam flow rate together with the temperature and flow rate of the furnace gases at the high temperature end of the firetube. The final superheated steam flows out through a nozzle formed within the saturated steam intake manifold, connecting the superheated steam to the superheated steam output manifold.

Among the advantages of the annular superheating element configuration of the instant invention are:

- This configuration of tubing and steam flow contained in a boiler firetube provides the most efficient heat transfer of hot furnace gases to superheat steam.
- A plurality of individual superheater elements can be connected together to provide uniform temperature superheated steam up to the design steaming capacity of a boiler.
- The superheater elements of the subject invention can be installed (retrofitted) in existing boilers or utilized in boilers of new construction.

The foregoing and other objects, features and advantages of the invention will be apparent from the following more particular description of preferred embodiments of the invention, as illustrated in the accompanying drawings.

BRIEF DESCRIPTION OF DRAWINGS

FIG. 1A is an example of a scotch wet-back horizontal firetube boiler and FIG. 1B is an example of a scotch dry-back horizontal firetube boiler.

FIG. 4B is a return end cap with an inner surface in the shape of half a horn torus. FIG. 4C is a return end cap with an inner surface in the shape of half of a hyperbolic curve rotated around a center axis. FIG. 4D is a return with an inner surface with the shape of a parabolic curve rotated around a center axis.

DETAILED DESCRIPTION OF PREFERRED EMBODIMENTS

Figure 3A:
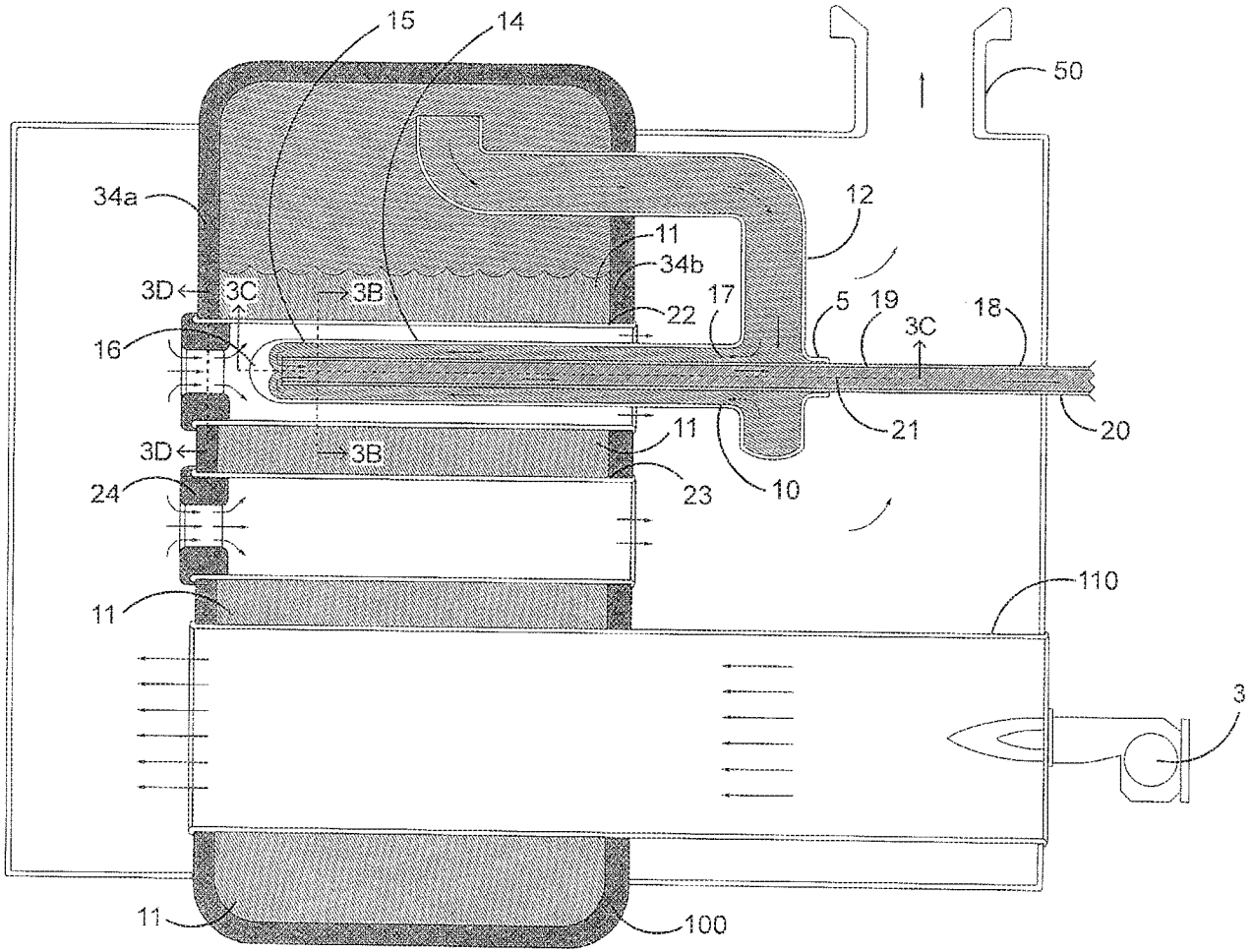
FIG. 3A is a longitudinal cross-sectional view showing in schematic form a preferred embodiment of an annular superheater element of the subject invention within a horizontal-type firetube boiler.
Figure 3D:
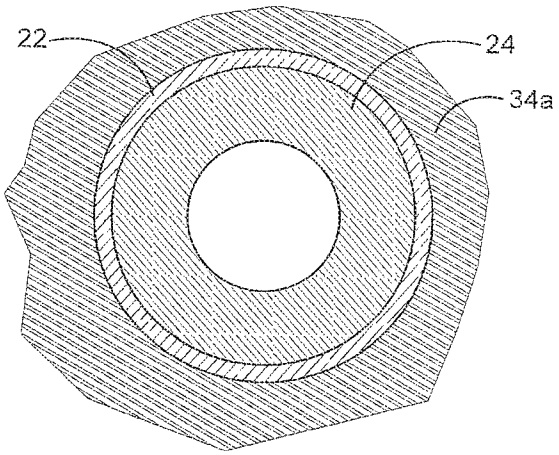
FIG. 3D is a transverse sectional view of the tube sheet, firetube, and choke thimble taken along Line 3D in FIG. 3A.
Figure 3B:
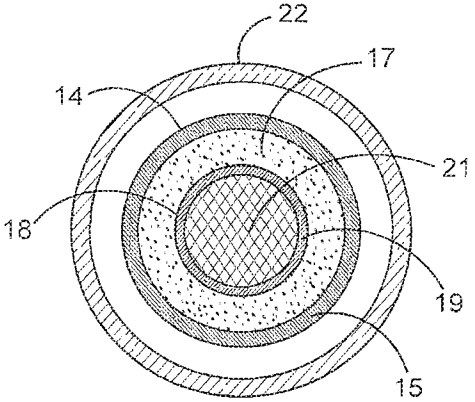
FIG. 3B is a transverse sectional view of the annular superheater element of the subject invention taken along Line 3B shown in FIG. 3A.
Figure 3C:
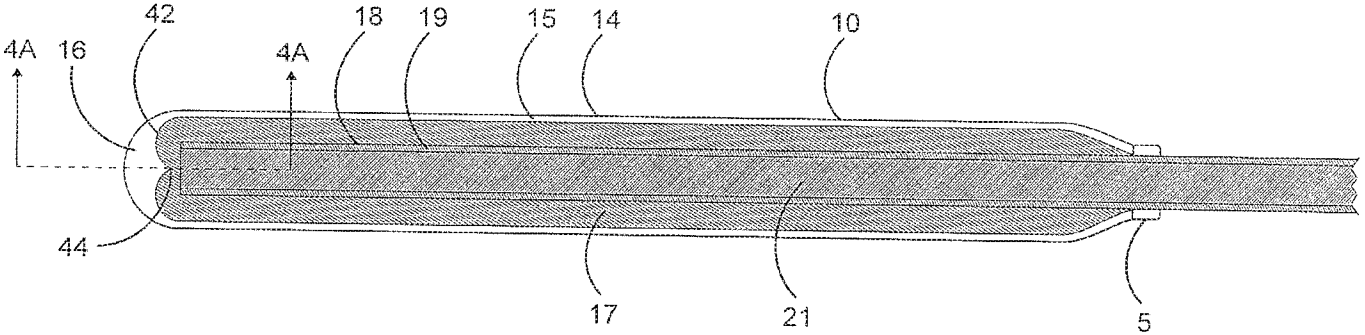
FIG. 3C is a longitudinal cross-sectional view of the annular superheater element of the subject invention taken along Line 3C shown in FIG. 3A.

One preferred embodiment of the superheater element of the subject invention is illustrated in FIG. 3A, a longitudinal cross-sectional view, FIG. 3B, a transverse sectional view on Line 3B in FIG. 3A, and FIG. 3C, a longitudinal cross-sectional view taken on Line 3C in FIG. 3A. As shown in FIGS. 3A through 3C, an improved annular superheater element 10 is comprised of a saturated steam inlet manifold 12, an outer tube 14, a specially designed return bend end cap 16, an inner tube 18, and a superheated steam outlet manifold 20. The first pass channel 17 is the annular steam path bounded by outer tube 14 and inner tube 18 and a second pass channel 21 is the steam path bounded by inner tube 18.

FIG. 3A shows a scotch dry-back horizontal firetube steam boiler 55 with two passes through the water 11 held in cylindrical boiler 100. The first pass comprises of a portion of furnace tube 110 and the second pass comprising of two firetubes 22 and 23, which are bounded by tube sheets 34*a* and 34*b*. Superheater element 10 of the subject invention has been inserted into firetube 22, whereas firetube 23 has been left empty.

Fuel is burned at the burner source 3, which is located on one side of the furnace tube 110. The burning of the fuel in burner source 3 heats the air within furnace tube 110. The high temperature gases, represented by arrows, flow through furnace tube 110, making a first pass through water 11. On the first pass, heat from the high temperature gases is absorbed through the walls of furnace tube 110 into water 11.

On the second pass through water 11, the high temperature gases traverse through firetubes 22 and 23. On the second pass, heat from the high temperature gases is absorbed through the walls of the firetubes 22 and 23. The heat absorbed by the water during the first and second passes causes water 11 to boil and make saturated steam. The saturated steam created by the boiling water rises to the top of boiler 100 and is channeled into saturated steam inlet manifold 12 into superheater element 10.

As illustrated in FIG. 3A, superheater element 10 extends into cylindrical boiler 100, with a portion of tubes 14 and 18, and all of return end cap 16, inside firetube 22 which is bounded by tube sheets 34*a* and 34*b*. While superheater element 10 could be inserted into firetube 22 at either side, in the preferred embodiment of the subject invention, superheater element 10 is inserted into the side of firetube 22 bounded by tube sheet 34*b*, which is the side that the furnace gases exit firetube 22. Accordingly, the furnace gases are hottest at return end cap 16 side of superheater element 10 and cooler at the side with inlet manifold 12.

The saturated steam, also represented by arrows, enters steam manifold 12, flows through manifold 12 into outer tube 14 of superheater element 10. The saturated steam flows toward the side of firetube 22 bounded by tube sheet 34*a* through first pass channel 17, which is the annular steam path bounded by outer tube 14 and inner tube 18, until it reaches return end cap 16. Return end cap 16, which is more fully described below, causes the steam flow to change direction 180 degrees diverting the steam flow into inner tube 18 of superheater element 10. Thereafter, the steam in inner tube 18 flows away from tube sheet 34*a* in the same direction as the furnace gases, towards superheater outlet manifold 20. Inner tube 18 passes through a nozzle 5 formed within saturated steam inlet manifold 12.

The saturated steam within outer tube 14 begins to absorb heat from the furnace gases through the wall 15 of tube 14 starting from where element 10 enters firetube 22. As the steam absorbs heat, the temperature of the steam within first pass channel 17 increases until it reaches return end cap 16. Thus, as the furnace gases flow through firetube 22, heat is transferred from the gases to both water 11 surrounding firetube 22 and to the saturated steam in first pass channel 17 through wall 15 of outer tube 14. When the superheated steam reaches return end cap 16, it is significantly hotter than the desired output temperature.

The steam is the hottest as it passes through return end cap 16. Return end cap 16 reverses the direction of the flow and directs the flow into second pass channel 21, which is the steam path bounded by inner tube 18. As the steam traverses second pass channel 21 from return end cap 16 towards the superheater outlet manifold 20, heat is transferred across wall 19 of inner tube 18 to the steam flowing within first pass channel 17. Accordingly, the steam in first pass channel 17 is heated by both the high temperature gases flowing through firetube 22 and the superheated steam flowing through second pass channel 21.

Outer tube 14, inner tube 18, and return end cap 16 can be constructed of a variety of materials capable of withstanding high pressure and temperatures and having good thermal conduction characteristics. Accordingly, cast and wrought iron, a material predominately used in prior art superheater elements but which transfers heat inefficiently and has low strength, is not a good choice of material for the concentric tubes of improved superheater element 10. According to preferred embodiments, outer tube 14 and inner tube 18 would be made from one or more of the following materials high quality carbon steel, stainless steel, and steel with chromium, molybdenum, and/or manganese alloys.

Similarly, it is important that there is no space or other obstruction or insulation materials between concentric tubes 14 and 18, as efficient transfer of heat between tubes 14 and 18 through wall 19 of inner tube 18 is essential to the proper functioning of superheater element 10.

Superheater element 10 can be inserted into firetubes of conventional firetube boilers, the subject invention not being limited to any particular embodiment or style of firetube boiler.

The diameter and length of tubes 14 and 18 and the length of superheated element 10 extending into the firetube 22 can be varied to change the temperature and steam flow rate in pounds per minute of the superheated steam output. Of the heat energy absorbed from the furnace gases, about two-thirds is absorbed to boil water 11 to make steam and about one-third is absorbed to superheat the steam. The number of superheater elements in the boiler and the length of the superheated element extending into the firetube will determine, together with other parameters, the final superheated steam temperature.

A preferred embodiment of the subject invention also anticipates the insertion of choke thimble 24 into one or more firetubes. Choke thimble 24 is inserted into the side of the firetube where the high temperature gases enter the firetube. The purpose of choke thimble 24 is to provide even furnace gas flow volumes between firetubes with and without superheater elements. Choke thimble 24 increases gas velocity and induces turbulent gas flow which increases heat transfer rate. Use of choke thimble 24 in those firetubes without superheater elements also prevents furnace gases from taking the path of least resistance through the empty firetubes without superheater elements, which would rob the heat energy from the superheater elements.

In the preferred embodiment illustrated in FIG. 3A, both firetubes 22 and 23 have choke thimbles 24. In another preferred embodiment illustrated in FIG. 5, two firetubes have choke thimbles while one firetube containing a superheater element does not. In a preferred embodiment, choke thimbles are made with heat resistant materials, such as ceramic. Metal choke thimbles have a short service life due to exposure to high temperatures.

FIG. 3B is a transverse sectional view of superheater element 10 taken along Line 3B in FIG. 3A and illustrates the concentric structure of the superheated element of the instant invention. The outermost ring is firetube 22. Inside the wall of fire tube 22 is outer tube 14. Inside wall 15 of outer tube 14 is inner tube 18. High temperature gases flow between the annular channel created between the wall of fire tube 22 and outer tube 14. First pass channel 17 is the channel bounded by outer tube 14 and inner tube 18 and second pass channel 21 is bounded by inner tube 18.

Referring to FIG. 3B, heat energy from the high temperature gases flowing between the annular channel created between the wall of fire tube 22 and outer tube 14 is absorbed through wall 15 of outer tube 14 heating the steam flowing through first pass channel 17. Similarly, heat energy from the higher temperature steam flowing between second pass channel 21 is absorbed through wall 19 of inner tube 18 heating the steam flowing through first pass channel 17.

FIG. 3C is a longitudinal cross-sectional view of superheater element 10 taken along Line 3C shown in FIG. 3A showing wall 15 of outer tube 14, first pass channel 17, wall 19 of inner tube 18, second pass channel 21, and nozzle 5. FIG. 3C also shows an inner surface 42 and a center 44 of return end cap 16, which are more fully described below.

FIG. 3D is a transverse sectional view taken along Line 3D in FIG. 3A showing choke thimble 24 fire tube 22, and a portions of tube sheet 34*a*. Choke thimble 24 reduces the flow of high temperature gases that enter firetube 22 by forcing the high temperature gases through a smaller diameter hole in its center. The hole in the center of the choke thimbles can vary in size. A larger hole would allow the gases through at a faster rate, whereas a smaller hole would allow the gases through at a slower rate.

Figure 4B:
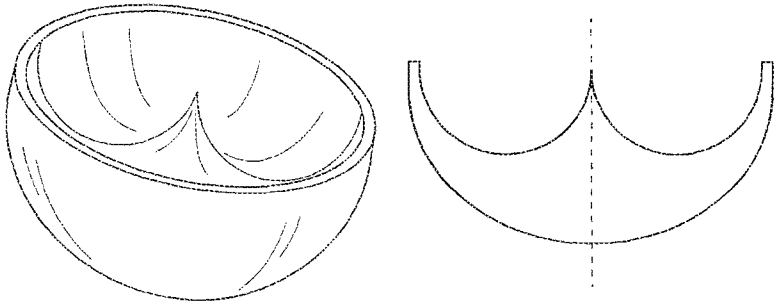
FIGS. 4B-4D are perspective views of the specially designed return end cap of the subject invention.
Figure 4D:
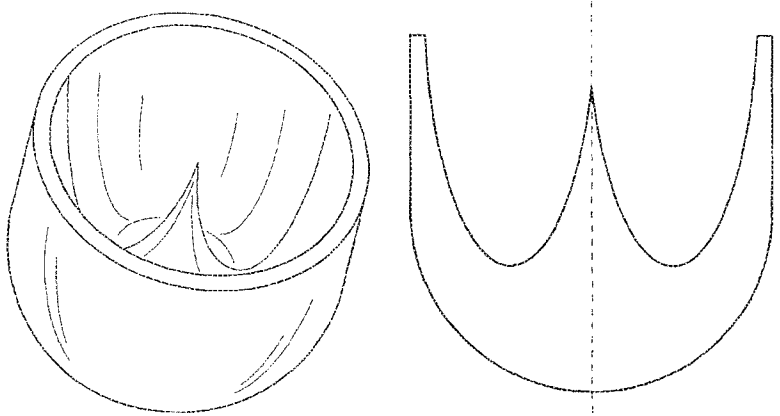
Figure 4A:
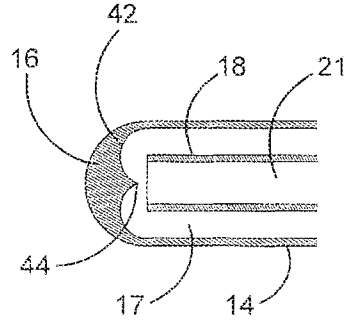
FIG. 4A is larger-scale view showing the return end cap and portions of the inner and outer tubes of the annular superheater element of the subject invention.

FIG. 4A is larger-scale sectional view taken along Line 4A in FIG. 3C showing the return end cap and portions of the inner and outer tubes of the annular superheater element of the subject invention. The purpose of return end cap 16 is to reverse the steam flow. The flow direction of steam in first pass channel 17 is changed 180 degrees and directed into second pass channel 21. Anytime steam is required to change direction, a force is exerted on the pipe wall or other surface causing the steam to change in direction. The impact of the steam flowing essentially into a dead end creates tremendous forces and severe turbulence. This force is proportional to the mass flow rate of the steam and is termed the velocity pressure. At nominal steam flow rates typical with steam piping external to the boiler, this force can exceed eleven times the force produced by the nominal pressure of the steam in the boiler and the superheater element components not subject to this velocity pressure. Failure to properly design and construct the return end cap to deal with the velocity pressure aspect of the steam flow reversal will result in significant erosion of the metal in the return end cap and unacceptable service life of the superheater element.

Return end cap 16 of the present invention is specially designed to prevent the serious turbulence and eddy currents described above that would otherwise produce erosion to return end cap 16 and the walls of tubes 14 and 18. Return end cap 16 acts like a vane of an impulse turbine to efficiently reverse and redirect the steam flow.

Figure 4C:
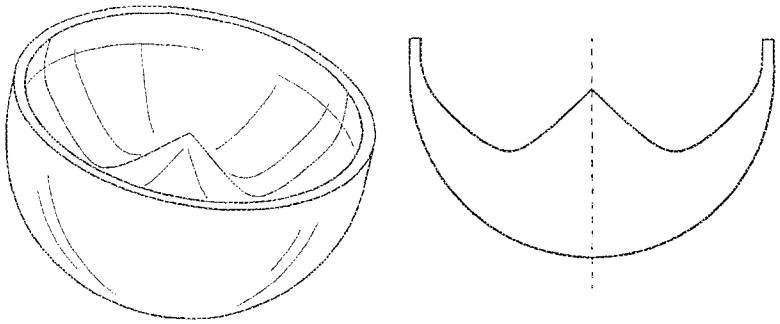

Return end cap 16 is rotationally symmetric at all angles of rotation along an axis shown as Line 4A in FIG. 3C. Return end cap 16 has inner surface 42 that has center 44, which extends towards inner tube 18. Inner surface 42 is a concave, smooth and continuous surface. In the preferred embodiment shown in FIG. 4B, the profile of inner surface 42 takes the shape of one half of a horn torus, which is the surface generated by revolving a circle about an axis of revolution that is tangent to the circle. According to alternative embodiments, inner surface 42 can also take the shape of a hyperbolic curve rotated about an axis of revolution, as illustrated in FIG. 4C or the shape of a parabolic curve rotated about an axis of revolution, as illustrated in FIG. 4D.

In a preferred embodiment, return end cap 16 can be made from turbine blade material such as a high carbon alloy steels that require special heat treatment to achieve a very hard surface resistant to erosion from the high pressure, high velocity steam flow. Because boiler codes do not allow the metallurgical elements required for high carbon alloy steels to be used in pressure boundaries, return end cap 16 may be fabricated from high carbon alloy steel encased in code compliant steel.

Figure 1A:
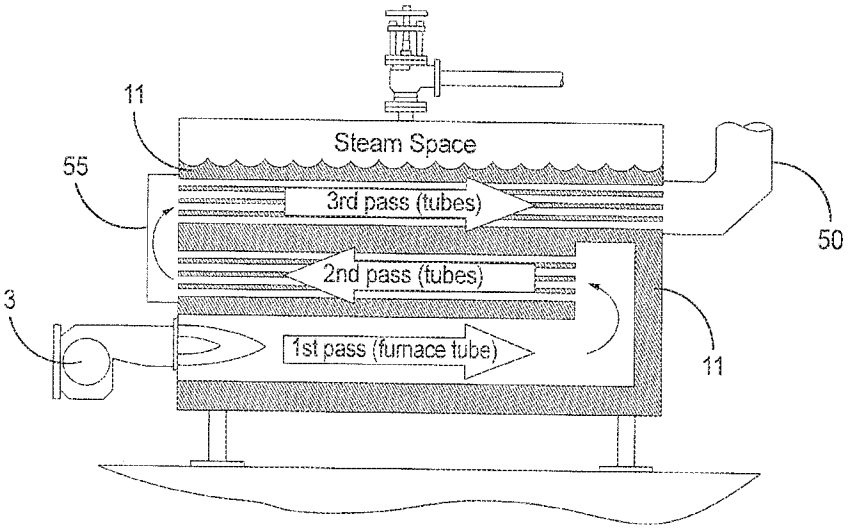
FIGS. 1A and 1B illustrate in schematic fashion the furnace gas and steam flow of two embodiments of conventional horizontal type firetube boilers.
Figure 1B:
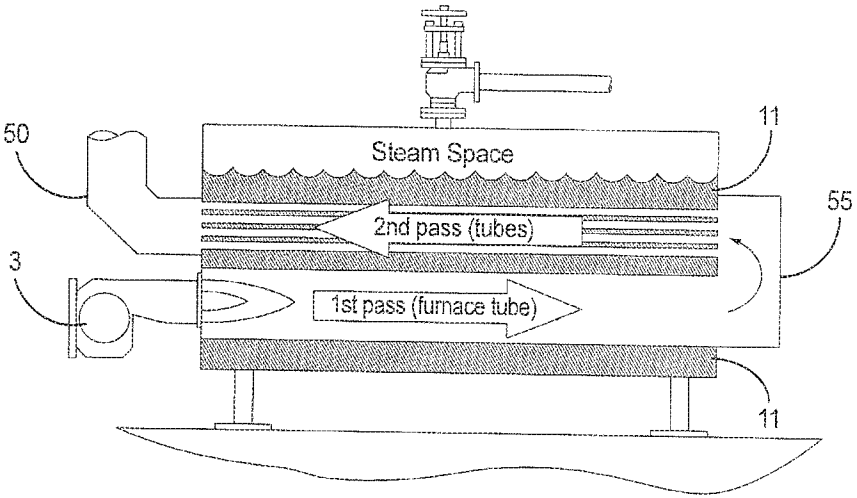
Figure 2A:
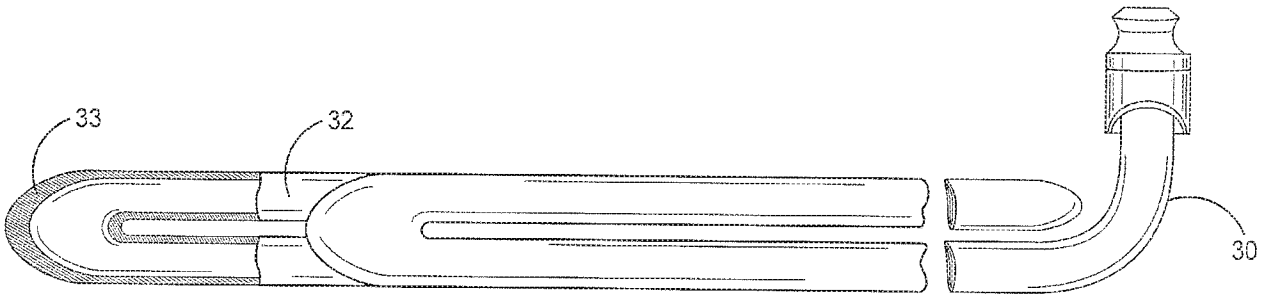
FIG. 2A depicts a traditional one-directional flow firetube superheater with multiple u-turns or passes.
Figure 2B:
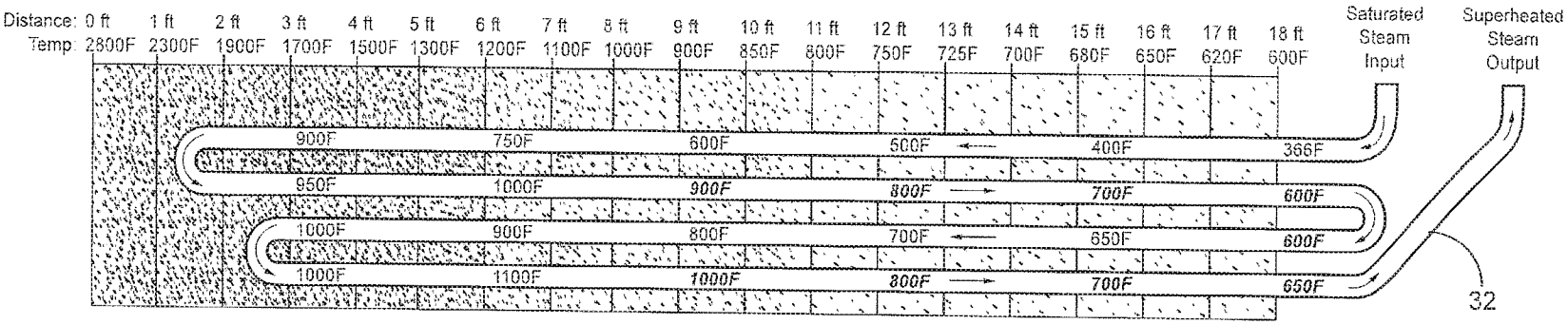
FIG. 2B is a schematic illustrating the thermodynamic effect of the superheated steam upon the exhaust gases in the context of the single tube of the traditional one-directional flow firetube superheater depicted in FIG. 2A.

The inefficiencies of traditional one directional flow firetube superheaters of the type illustrated in FIG. 2A is shown in FIG. 2B. FIG. 2A shows a traditional one directional flow firetube superheater 30 is comprised of a single tube 32 having three 180 degree bends. FIG. 2B shows conventional superheater 30 in schematic, showing the temperature of the firetube gases at various distances away from the side of firetube where the high temperature gases enter and the temperature of the superheated steam at various points along tube 32.

As can be seen in FIG. 2B, the superheated steam in tube 32 demonstrates temperatures greater than the surrounding firetube gases on the side of the firetube closest to where the high temperature gases enter the firetube, the furnace side, and temperatures lower than the surrounding firetube gases on the side of the firetube further away from where the high temperature gases enter the firetube. As such, after the first and third passes (bends), the superheated steam within tube 32 on the side away from the furnace loses heat through tube 32 to the gases within the firetube. This loss of heat energy, from the superheated steam to the furnace gases, results in output steam of a lower temperature and makes the process of heating superheated steam less efficient.

Figure 5:
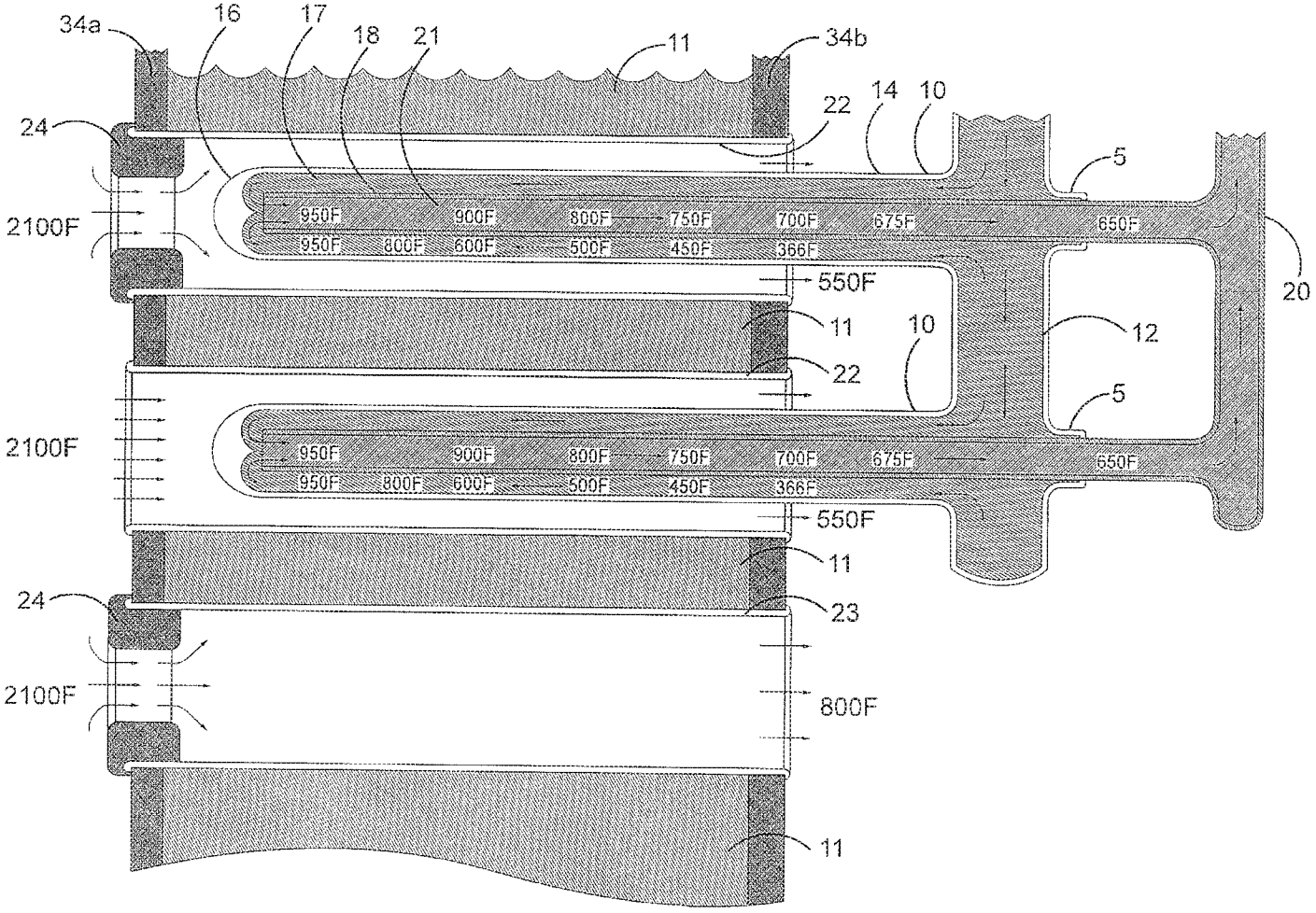
FIG. 5 is a schematic view showing a further embodiment of the annular superheater element of the subject invention comprised of multiple annular superheater elements.
Figure 6:
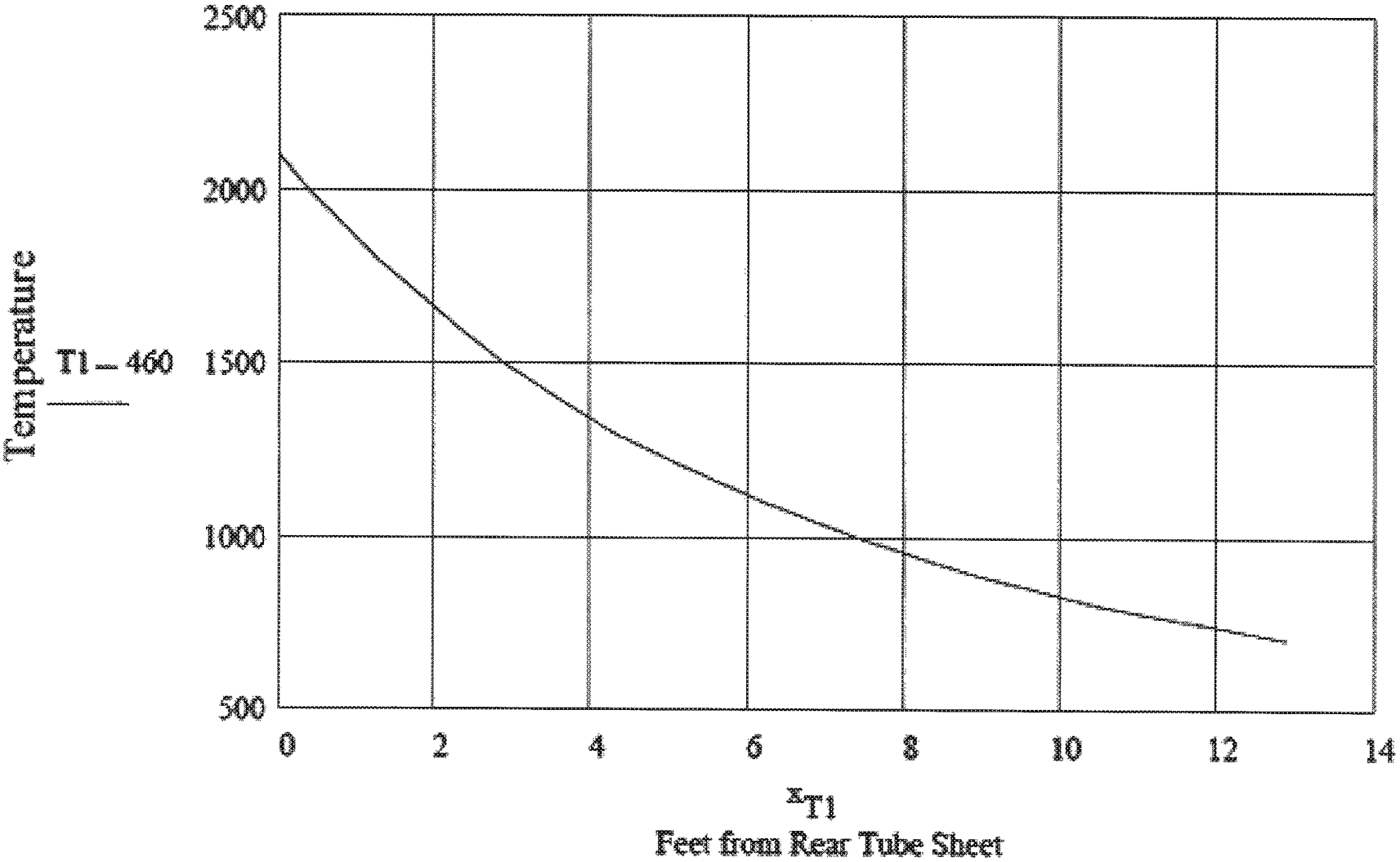
FIG. 6 is a chart showing the temperature of the furnace gases in degrees Fahrenheit within the firetube as a function of the distance from the tube sheet on the high temperature side of the firetube.

FIG. 5 is an illustration showing a further embodiment of the annular superheater element of the subject invention comprised of multiple annular superheater elements and the thermodynamic effect of the superheated steam upon the high temperature gases. The temperature of the furnace gases in degrees Fahrenheit within the firetube as a function of the distance from the tube sheet on the high temperature side of the firetube is illustrated in the graph shown in FIG. 6.

Efficiency and rate of heat transfer is exponentially proportional to the difference in the heat temperatures. As such, about two-thirds of the available heat is given up to the boiler in the first one-third of the firetube length from the furnace end.

In the prior art example shown in FIG. 2B, the superheater tube traverses the firetube four times attempting to absorb heat from the furnace gases. For approximately 30% of the superheater tube length, those areas where temperatures are indicated in bold italic font in FIG. 2B, the temperature of the superheated steam in the tube exceeds the temperature of the furnace gases in the firetube.

Referring to FIG. 5, saturated steam enters superheater element 10 through inlet manifold 12 at 366° F. at 150 psi. As the steam travels in first steam pass channel 17, towards the return end cap 16, heat is transferred through outer tube 14 from the hotter furnace gases flowing within firetube 22, heating, in this example, the saturated steam from 366° F. to 950° F. at 150 psi. At the side of superheater element 10 closest to where the high temperature gases enter firetube 22, where the superheated steam is returned into inner tube 18 by return end cap 16, the temperature of the superheated steam in outer tube 14 is the same as the temperature of the superheated steam in inner tube 18.

Still referring to FIG. 5, as the superheated steam flows down second steam pass channel 21 in inner tube 18 from the side of element 10 closest to where the high temperature gases enter firetube 22 to the inlet/outlet side of element 10, the temperature of the superheated steam drops from, in this example, 950° F. to 650° F. at 150 psi, the temperature and pressure at which it exits from outlet manifold 20. During the latter portion of this flow, the temperature of the superheated steam within the steam second pass in the inner tube 18 is higher than the temperature of the superheated steam within first pass channel 17 between the outer tube 14 and the inner tube 18 and heat is transferred from the superheated steam within inner tube 18 to the superheated steam within outer tube 14, through inner tube 18, rendering the process of superheating steam more efficient. This is in contrast with the thermodynamics illustrated for traditional firetube element 30 in FIGS. 2A and 2B wherein, during the transit of superheated steam from the return end cap side of the element to the exhaust side of the element, the superheated steam loses heat energy to the furnace gases that eventually are exhausted, rather than to the superheated steam that is the desired product of the process.

Shown in FIG. 5, again by way of a schematic, is an alternative embodiment annular superheater element wherein a plurality of interconnected annular superheater elements 10 are used. As with the single annular element embodiment described in FIG. 3A, saturated steam enters inlet manifold 12. From there, however, the steam flows through one of two outer tubes 14, towards the side of the firetube bounded by tubesheet 34*a*, is returned by return end cap 16, flows back towards the side of the firetubes bounded by tubesheet 346 through inner tube 18, which passes through nozzle 5 formed within saturated steam inlet manifold 12 and then exits together through outlet manifold 20.

Conventional firetube boilers can be easily and inexpensively retrofitted with superheater element 10 to produce superheated steam capable of doing substantially more work with less fuel than the firetube boiler before conversion. To retrofit a conventional firetube boiler, superheater elements 10 are inserted into one or more of the existing firetubes. Elements 10 are inserted through tube sheets and positioned within firetubes so that the intake saturated steam manifold side of element 10 is on the side of the firetube in which the high temperature gases flowing within exit the firetube. In this configuration, the saturated steam within first pass channel 17 will flow towards the hotter furnace gases, while the saturated steam within second pass channel 21 will flow away from the hotter furnace gases.

When retrofitting conventional firetube boilers, superheater element 10 is sized in length and diameter to be compatible with the diameter and length of the firetubes within the boiler to be retrofitted. Choke thimbles 24 are inserted or removed as appropriate to the firetube pattern.

Although the embodiment of the improved annular superheater element illustrated in FIG. 5 is comprised of only two elements 10, the improved superheater element of the subject invention can be used in sets of three or in any number appropriate to the size and other structural parameters of the firetube boiler in question. Several multiple individual superheater elements may be connected to a common manifold creating a bank of superheater elements. Multiple banks of superheater units may be connected to a larger manifold for delivery of the superheated steam to the boiler outlet.

Further, each of the multiple elements can have its own inlet and outlet manifold, or some of the elements can share a manifold whereas others may not. In addition, although superheater elements 10 in FIG. 5 are inserted into individual firetubes 22, more than one superheater element 10 can be inserted into a single firetube without departing from the intention and scope of the instant invention.

SUMMARY AND SCOPE

As described above and illustrated in the accompanying figures, the improved annular superheater element of the instant invention allows for the more efficient production of superheated steam using conventional firetube-type boilers. The improved element can produce more superheated steam of a given volume and temperature with less fuel, can produce the same volume of superheated steam of a higher temperature using the same amount of fuel, and can produce superheated steam that is capable of doing more work relative to prior art firetube boilers using conventional superheater elements.

The improved annular superheater elements of subject invention can be used to retrofit existing firetube boilers or can be used in boilers of new construction. Given that a report prepared by the Energy and Environmental Analysis, Inc. dated May 2005 for the United States government estimates that there are approximately 120,000 commercial firetube style boilers currently in use in the United States alone (see table below), the potential for increased work and energy and fuel savings that can be realized by converting existing firetube boilers is considerable.

Commercial Boiler Inventory

| Building Type | Number of Boilers | Boiler Capacity (MMBtu/hr) | Average Size (MMBtu/hr) |
|---|---|---|---|
| Office | 28,030 | 297,090 | 10.6 |
| Warehouse | 5,365 | 72,385 | 13.5 |
| Retail | 5,585 | 47,230 | 8.5 |
| Education | 35,895 | 128,790 | 3.6 |
| Public Assembly | 7,280 | 55,205 | 7.6 |
| Lodging | 10,545 | 140,830 | 13.4 |
| Health | 15,190 | 317,110 | 20.9 |
| Other | 11,900 | 88,970 | 7.5 |
| Total | 119,790 | 1,147,610 | 9.6 |

Unless otherwise indicated, all numbers, dimensions, materials and so forth used in the specification and claims are to be understood as being examples and not limitations, and in any event, not as an attempt to limit the application of the doctrine of equivalents to the scope of the claims.

The terms "a," "an," "the," and similar references used in the context of describing the invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of any claim. No language in the specification should be construed as indicating any non-claimed element essential to the practice of the invention.

Certain embodiments are described herein, including the best mode known to the inventor for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein.

Accordingly, the claims include all modifications and equivalents of the subject matter recited in the claims as permitted by applicable law. Moreover, any combination of the above-described elements in all possible variations thereof is contemplated unless otherwise indicated herein or otherwise clearly contradicted by context.

By way of example, and not limitation, the temperatures and pressures described in the specification and figures and given as examples. A variety of temperatures and pressures for superheated steam within and produced by firetube boilers are known in the art, and all such temperatures and pressures may be practiced in the instant invention. Further, while the improved annular superheater element of the subject invention has been described and claimed in the context of traditional horizontal-type firetube boilers, the improved superheater element can be used in other types of firetube boilers as well as in boilers without firetubes.

In closing, it is to be understood that the embodiments disclosed herein are illustrative of the principles of the claims. Other modifications that may be employed are within the scope of the claims. Thus, by way of example, but not of limitation, alternative embodiments may be utilized in accordance with the teachings herein. Accordingly, the claims are not limited to embodiments precisely as shown and described.

I claim:

1. A superheater element for superheating steam within a firetube of a firetube boiler comprising:

an outer tube concentric about an inner tube, said outer and inner tube each having a return end and a non-return end;

an inlet manifold connected to the non-return end of said outer tube;

an outlet manifold connected to the non-return end of said inner tube; and a return affixed to the return end of said outer tube, said return having an interior face and a central axis parallel to and shared by the inner and outer tubes;

wherein the interior face of said return is rotationally symmetric at all angles of rotation about the central axis; and wherein a point of said interior face is raised towards the return end of said inner tube along said central axis without extending into the inner tube.

2. A superheater element of claim 1 wherein said interior face of said return is described as the bottom-half of the surface of a horn torus wherein the axis of rotational symmetry of said horn torus is the central axis shared by said outer and inner tubes.

3. A superheater element of claim 1 wherein said interior face of said return has a surface described by a portion of the surface of revolution generated by revolving a parabola in a three-dimensional space about an axis of rotation that intersects with said parabola and is parallel with the axis of symmetry of said parabola wherein said axis of rotation is the central axis shared by said outer and inner tubes.

4. A superheater element of claim 1 wherein said interior face of said return has a surface described by a portion of the surface of revolution generated by revolving one branch of a hyperbola in a three-dimensional space about an axis that intersects with said hyperbola branch and is parallel with the axis of symmetry of said hyperbola branch, wherein said axis of rotation is the central axis shared by said outer and inner tubes.

5. The superheater element of claim 1 wherein said boiler has a burner end opposite an exhaust end and said superheater element extending within said boiler from the burner end to the exhaust end.

6. The superheater element of claim 1 wherein the wall of the inner tube is shaped and sized to maximize the thermal conductivity between the inner and outer tubes, giving consideration to the tube material, and the pressure and temperature of the superheated steam flowing through said inner and outer tubes.

7. The superheater element of claim 1 wherein said inner and outer tubes are fabricated from material selected from a group consisting of carbon steel, stainless steel, and steel comprising chromium, molybdenum, and manganese alloys.

8. The superheater element of claim 1 wherein said return is fabricated from erosion resistant material comprising heat treated high carbon alloy steels.

9. The superheater element of claim 1 wherein said return is fabricated from erosion resistant material comprising turbine blade material.

10. The superheater element of claim 5, wherein saturated steam introduced into said inlet manifold gains heat energy while traveling along the outer tube towards the exhaust end of said boiler, is directed into said inner tube by said return, and then loses heat energy to the saturated steam within said outer tube while traveling within said inner tube towards the burner end of said boiler before exiting the outlet manifold.

11. A method for superheating steam using a superheater element inserted into the firetube of a firetube boiler, said boiler having a burner end opposite an exhaust end, comprising the steps of: providing a superheater element having an outer tube concentric about an inner tube, said outer and inner tube each having a return end and a non-return end; an inlet manifold connected to the non-return end of said outer tube; an outlet manifold connected to the non-return end of said inner tube; and a return affixed to the return end of said outer tube, said return having an interior face and a central axis parallel to and shared by the inner and outer tubes; wherein the interior face of said return is rotationally symmetric at all angles of rotation about the central axis; and wherein a-point of said interior face is raised towards the return end of said inner tube along said central axis without extending into the inner tube introducing saturated steam into said inlet manifold of said element; causing said steam to travel within the outer tube towards the exhaust end of said boiler while absorbing heat energy from heated firetube gasses through the wall of the outer tube; directing said now superheated steam into said inner tube by means of said return; causing said superheated steam to travel within the inner tube towards the burner end of said boiler while losing heat energy to said saturated steam in said outer tube through the wall of saki inner tube; and causing said superheated steam to exit said outlet manifold.

12. A method for retrofitting firetube boilers to superheat steam comprising the steps of: (a) providing one or more superheater elements each comprising an outer tube concentric about an inner tube, said outer and inner tube each having a return end and a non-return end; an inlet manifold connected to the non-return end of said outer tube; an outlet manifold connected to the non-return end of said inner tube and a return affixed to the return end of said outer tube, said return having an interior face and a central axis parallel to and shared by the inner and outer tubes; wherein the interior face of said return is rotationally symmetric at all angles of rotation about the central axis; and wherein a point of said interior face is raised towards the return end of said inner tube along said central axis without extending into the inner tube (b) providing an existing firetube boiler; and (c) inserting said superheater elements into one or more firetubes of the existing firetube boiler.

13. The method of claim 12 wherein said firetube boiler already produces superheated steam and is retrofitted to superheat steam more efficiently compared with before the retrofit, by reducing the heat loss from the superheated steam to the boiler.

14. A method for retrofitting firetube boilers to superheat steam comprising the steps of: (a) providing one or more superheater elements each comprising an outer tube concentric about an inner tube, said outer and inner tube each having a return end and a non-return end; an inlet manifold connected to the non-return end of said outer tube; an outlet manifold connected to the non-return end of said inner tube; and a return affixed to the return end of said outer tube, said return having an interior face and a central axis parallel to and shared by the inner and outer tubes; wherein the interior face of said return is rotationally symmetric at all angles of rotation about the central axis; and wherein a point of said interior face is raised towards the return end of said inner tube along said central axis without extending into the inner tube; (b) providing an existing firetube boiler; (c) providing one or more choke thimbles; (d) inserting said superheater elements into one or more firetubes of the existing firetube boiler; and (e) inserting a choke thimble into each firetube of the existing firetube boiler.

15. The method for retrofitting firetube boilers to superheat steam of claim 14, wherein only some of the firetubes have superheater elements and choke thimbles are used on only the firetubes that do not have superheater elements.

16. The method of claim 14 wherein said firetube boiler already produces superheated steam and is retrofitted to superheat steam more efficiently compared with before the retrofit, by reducing the heat loss from the superheated steam to the boiler.

* * * * *